US006357640B1

(12) United States Patent
Rickard et al.

(10) Patent No.: US 6,357,640 B1
(45) Date of Patent: Mar. 19, 2002

(54) CARRIER FOR DIFFERENTLY SIZED CASINO COIN BUCKETS AND METHOD FOR MAKING SAME

(75) Inventors: Gail A. Rickard; Lois J. Brinker, both of Imlay City, MI (US)

(73) Assignee: Slot Slinger, Inc., Imlay City, MI (US)

( * ) Notice: Subject to any disclaimer, the term of this patent is extended or adjusted under 35 U.S.C. 154(b) by 0 days.

(21) Appl. No.: 09/397,906

(22) Filed: Sep. 17, 1999

(51) Int. Cl.[7] ..... B65D 5/00

(52) U.S. Cl. ..... 224/236; 150/150; 224/610; 224/625; 224/660

(58) Field of Search ..... 224/625, 610, 224/236, 677, 663, 664, 684, 660, 676, 680, 681, 682, 148.1, 148.4, 607, 657; 190/103–107, 21, 22; 150/150; 383/34

(56) References Cited

U.S. PATENT DOCUMENTS

| | | | | |
|---|---|---|---|---|
| 4,325,503 A | | 4/1982 | Swinney | |
| 4,708,273 A | | 11/1987 | Grant | |
| 4,941,603 A | * | 7/1990 | Creamer et al. | 224/148.1 |
| 4,974,761 A | * | 12/1990 | Luque | 22/148.1 X |
| 5,158,220 A | * | 10/1992 | Glass | 224/657 |
| 5,240,158 A | | 8/1993 | Walsh | |
| 5,259,541 A | | 11/1993 | Reese | |
| 5,386,932 A | | 2/1995 | Gross | |
| 5,431,319 A | | 7/1995 | Cavadini et al. | |
| 5,465,888 A | | 11/1995 | Owens | |
| 5,465,889 A | * | 11/1995 | Smith | 224/677 |
| 5,810,166 A | * | 9/1998 | Weinreb | 224/236 |
| 5,836,497 A | | 11/1998 | Pelish | |
| 5,864,289 A | | 1/1999 | Tiemann | |
| 6,029,877 A | * | 2/2000 | Woods | 224/153 X |

FOREIGN PATENT DOCUMENTS

| | | | | |
|---|---|---|---|---|
| FI | 0021519 A | * | 12/1946 | 190/103 |
| FR | 0900412 A | * | 6/1945 | 190/103 |
| GB | 2018580 A | * | 10/1979 | 190/103 |
| NO | 53574 | | 2/1934 | |

* cited by examiner

*Primary Examiner*—Stephen K. Cronin
*Assistant Examiner*—Maerena W. Brevard
(74) *Attorney, Agent, or Firm*—Brooks & Kushman P.C.

(57) ABSTRACT

A carrier capable of carrying one or more differently sized coin buckets typically provided by casinos to their clientele. The carrier can be adapted so that it is held to the body of the user via means of a belt or a shoulder strap. The carrier can be adapted to accommodate differently sized casino coin buckets by reconfiguring various connectable sections of the carrier. A method is described whereby the carrier is made by sewing together sturdy pieces of fabric.

15 Claims, 5 Drawing Sheets

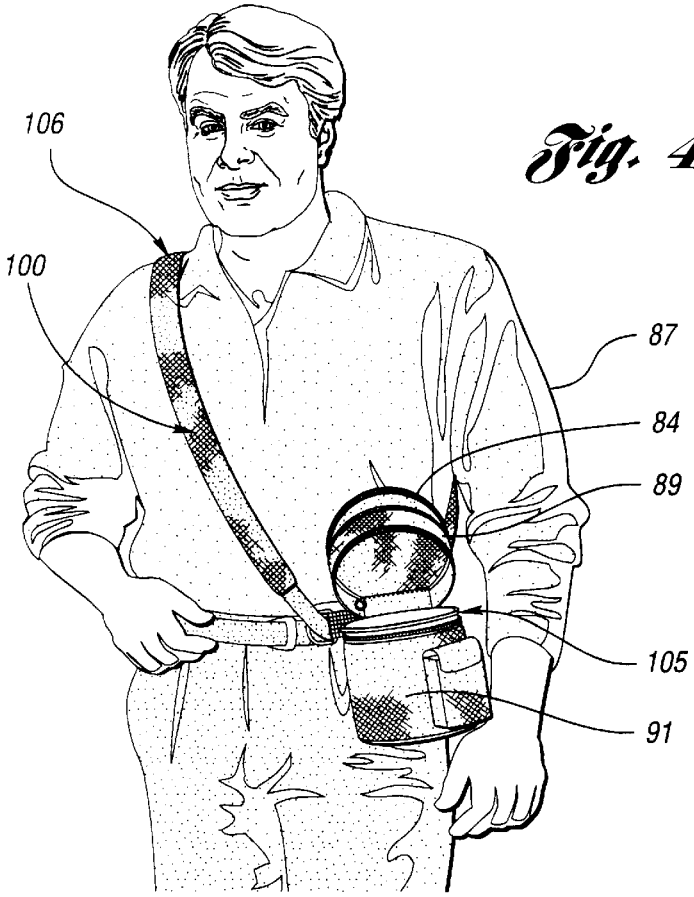
Fig. 4
Fig. 5
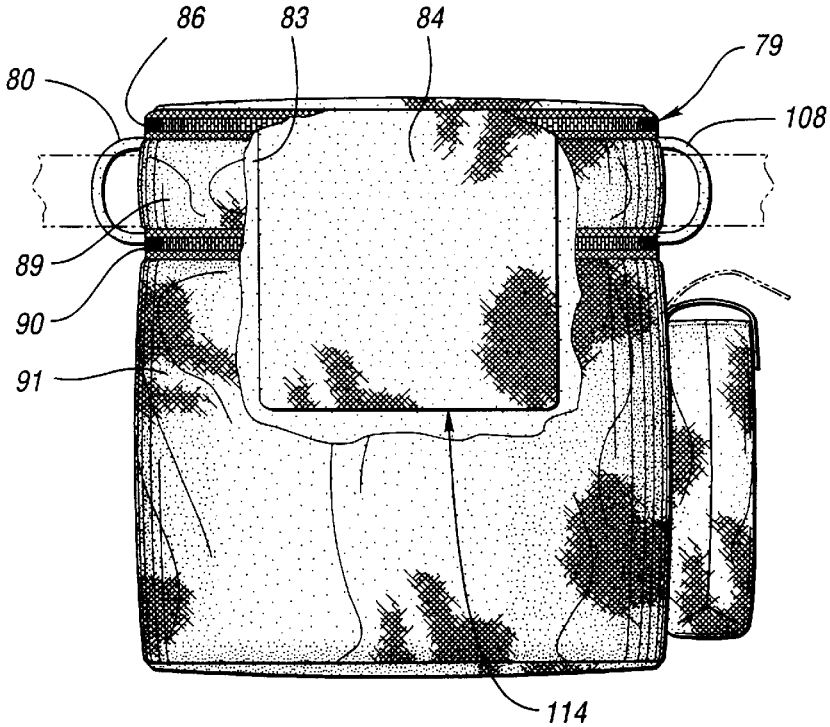

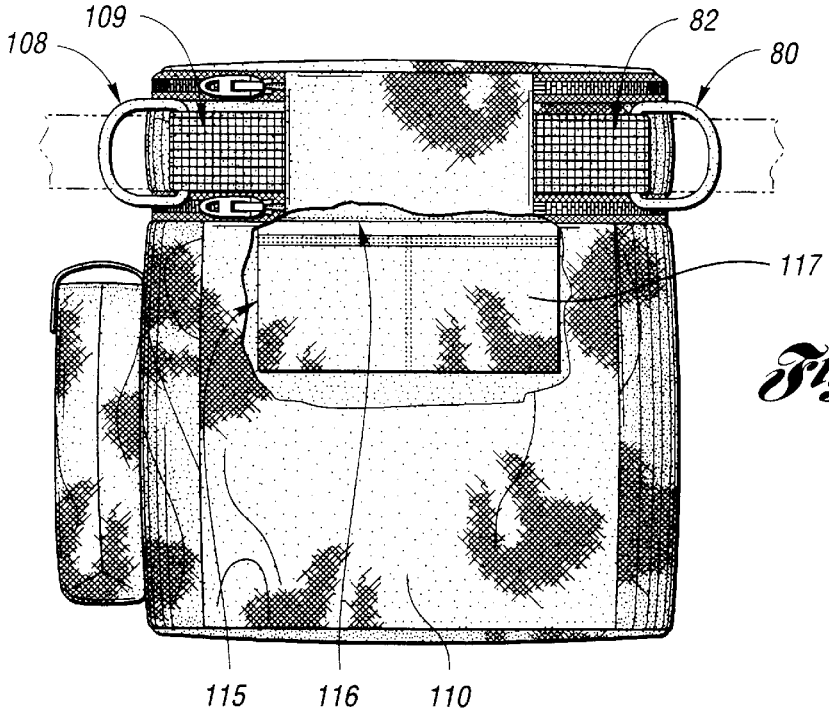
Fig. 6
Fig. 7
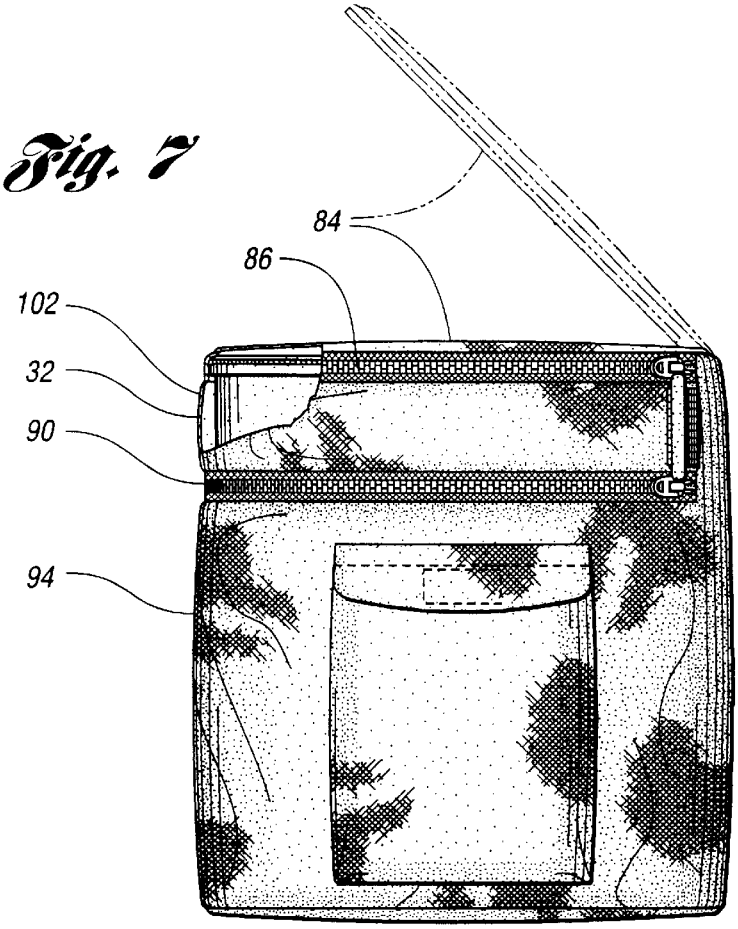

CARRIER FOR DIFFERENTLY SIZED CASINO COIN BUCKETS AND METHOD FOR MAKING SAME

TECHNICAL FIELD

This invention relates to a carrier or pouch-like apparatus for carrying different sized commonly used casino coin buckets.

BACKGROUND ART

The casino gaming industry is booming throughout the United States and the rest of the world. People flock to casinos and casino resorts in ever greater numbers each year. There are cities throughout the United States such as Las Vegas, Nev. and Atlantic City, N.J., whose reputation as a place for casino gambling is its number one tourist attraction. There is every indication that the trend towards casino gambling in the United States and throughout the world will continue to increase.

Gambling casinos throughout the United States offer a wide array of games of chance including various types of card games, roulette and sports betting. Whatever types of gaming a casino might offer, virtually all casinos have slot machines. Statistics have shown that slot machines are the most popular game of chance amongst casino-goers.

Slot machines are operated by inserting a coin or coins into a designated slot, pulling a lever or pressing a button, and then watching and waiting as three cylinders, each having a variety of symbols drawn on it, spin around, each coming to rest one by one, with the casino gambler winning if one or more of the series of symbols is displayed and/or lined up in a pre-determined sequence. If any of these pre-determined sequences is displayed when all the cylinders stop spinning, the machine dispenses a pre-determined number of coins which correspond to the symbols or the sequence of symbols which are displayed on the three cylinders.

A common thread running between all slot machines is that they are all coin operated. Recognizing that most casino-goers who "play the slots" usually play several games at any one slot machine and/or several games at a number of different slot machines, either of which require numerous coins, casinos distribute one of two standard-sized coin buckets to assist their customers in carrying their coins.

While the casino bucket is a convenient way of keeping the coins together, it still requires the slot machine player to use his or her hand or hands to hold the coin bucket. This in turn becomes cumbersome and inconvenient, requiring the customer to occupy at least one of his or her hands all the time. Many gamblers smoke tobacco products while gambling and also partake in the beverage services provided by many casinos. Using one hand to hold a coins can, therefore, presents a serious obstacle to gambling.

One inventor, Pelish in U.S. Pat. No. 5,836,497 issued Nov. 17, 1998, attempted to resolve the problem of having to carry the casino bucket by hand. She disclosed a pouch using darts and an elastic gather to form a pouch using several pieces of material. While Pelish may have recognized the problem of carrying a casino bucket by hand, her invention creates other problems which are not present in the present invention. First, the Pelish pouch is a "one size fits all" device. As stated earlier, casino buckets come in one of two different sizes. The Pelish pouch is too small for some and too big for others. This creates the risk of either inadvertently toppling the larger casino bucket or inconveniently allowing the smaller casino bucket to slip beneath the open mouth of the pocket whose elastic gathers would close the pouch over top of the bucket making access to the bucket difficult and inconvenient.

The second problem with the Pelish pouch is that it does not have a cover. This creates several problems. First, without a cover, the coins held in the Pelish pouch can more easily be pilfered than they could if they were carried in a pouch with a cover. Second, as the pouch is likely to rest against a person's upper thigh or hip, the jostling which results from walking can cause coins to fall out of the casino bucket. Third, when unstrapped and removed from the body of the gambler, if the pouch is dropped or knocked over, the contents will spill out.

The third problem created by the Pelish pouch is its appearance. The incorporation of darts into the design of the Pelish pouch creates wrinkles and gathers in the material. In sharp contrast, however, the present invention is compact, smart, and has very clean lines. The material can be embroidered with any of a number of icons familiar to the gambling public, such as dice, cards, slot machine displays, and roulette wheels. Furthermore, even when the cover is not zippered closed, it will fall into place over top of the bucket and create a neat, clean, and tidy appearance while the Pelish pouch, because of its one size fits all approach to carrying casino coin buckets, will always appear either open, or partially closed and poorly fitted to the coin bucket within.

The fourth problem with the Pelish pouch is the lack of security created by the design and location of the upper pocket. The upper pocket of the Pelish pouch is designed to receive the person's personal articles. It has no lid, and because of its design, any personal items placed inside the pocket will either cause the pocket to bulge, or to remain open, allowing others an unobstructed view into the pocket's interior. One of the main purposes of the present invention is to have all of the gambler's valuables securely held inside the device in an internal zippered pouch. When stored in such an internal pouch, the valuables would be out of sight, and consequently, less vulnerable to theft.

The fifth problem with the Pelish pouch is that it does not accommodate cigarettes or hand wipes. These are crucial oversights which the present invention remedies. Statistics show that a large percentage of gamblers are also smokers. The present invention accommodates these smokers by providing a covered pouch attached to the side of the main pouch tailored to accommodate a pack of cigarettes. Furthermore, anyone who patronizes slot machines for any length of time will find that their hands get very dirty. This is because the coins themselves are very dirty. To keep their hands clean, gamblers frequently carry hand wipes with them. The present invention accommodates this need by providing an accessible internal pocket large enough to hold a number of average sized hand wipes.

DISCLOSURE OF INVENTION

In accordance with the teachings of the present invention, a pouch or carrier is disclosed in one embodiment that is specially configured to allow the user to secure it to his or her body either around the waist or slung over the shoulder. The carrier can be configured by the user to carry either of the two standard sized casino coin buckets. In either configuration, a cover can be affixed over the top opening to prevent theft and secure the coins internally. The carrier is constructed from an assembly of durable cloth-like materials that are sewn together and/or configured through the use of resealable means, including, but not limited to, snaps, buttons, zippers, and hook and loop members, such as the trademarked Velcro. The carrier comprises two axially aligned cylindrical compartments, both of which are closed at one end and openable at the other end by using the above-described resealable means. By using one or the other of the two configurations, the carrier can be adjusted to accommodate the differing heights of the two standard casino coin buckets. Additionally, an internal pocket is provided immediately below the cover and along the side of the cylinder closest to the body of the person wearing the carrier. This pocket can be used for carrying money and other personal effects, and is designed in such a way so as to be kept out of sight yet readily accessible. The carrier may also contain another internally mounted pocket opposite to the first internal pocket, it can be used for holding hand-wipes, tissues, and other articles for cosmetic and/or personal hygiene purposes.

Other embodiments include a ring to which a standard bungee cord can be attached and used to hold the casino customer's casino card in a secure location. In still another embodiment, an additional pouch and cover suitable for holding a pack of cigarettes can be affixed to the outside of the pouch for easy access during gambling. In yet other embodiments, the pouch can be configured to be worn either around the wearer's waist or slung over the wearer's shoulder.

Accordingly, it is an object of this invention to provide a carrier capable of carrying one of a plurality of differently sized coin buckets comprising a pocket which is adapted to be supported by the user and having first and second pocket portions which are axially aligned and at least partially connectable, and configured in accordance with their connection to contain a respective one of a plurality of differently sized coin buckets such that when the first and second pocket portions are connected, the pouch is configured to contain a coin bucket of one size, and when the first and second pocket portions are at least partially disconnected, the pouch is configured to contain a coin bucket of another size.

A more specific object of this invention is a method to create a pouch of predetermined length which can be worn by a person to secure and bear the weight of differently sized cylindrical objects. To make the pouch, provide a back section of sufficiently sturdy material to support an eight inch cylindrical object full of coins, the sides of which run the entire pre-determined length of the pouch and the end of which has a tab protruding therefrom. Provide a front and sides section, made of the same material and having a width approximately equal to the circumference of the object support section minus the width of the back section, having an axial dimension at the ends thereof approximately equal to the axial dimension of the back section minus the protrusion of the tab from the back section. Sew pouch pocket on front and sides section. Then sew the front and sides section to the back section such that the stitches join the shorter sides of the front and sides section to the sides of the back section. Then provide a circular object support section, made of the same material and having a circumference approximately equal to the circumference of the cylinder formed by joining the back section with the front and sides section. Then sew the circular object support section to the front and sides and back section on the side opposite to the side having the protruding tab to form a cylinder. Then provide a mostly circular cover section, made of the same sufficiently sturdy material. Sew the cover section to the top of the tab protruding from one portion of the back section. Then provide a front zipper insert section made of the same sufficiently sturdy material and having a width approximately equal to the circumference of the circular cover section minus the width of the tab protruding from the end of the back section and having an axial dimension approximately equal to the protrusion of the tab from the end of the back section. Connect the circular cover section to one side of the front zipper insert section by reconnectable means, such as a zipper, buttons, snaps, or a hook and loop system such as Velcro™. Connect the other side of the front zipper insert section to the front and sides section by a second reconnectable means, such as a zipper, buttons, snaps, or a hook and loop system such as Velcro™.

This pouch can be further advanced by sewing two rectangular segments of the sufficiently sturdy material, each having a vertical height approximately equal to the axial dimension of the front zipper insert section, to the vertical portions of the tab protruding from the back section such that only one rectangular segment is sewn to each vertical portion of the tab. Then fold each rectangular segment in half, insert one D-ring over the free end of each folded rectangular segment, and then sew the free end of each rectangular segment to form a loop.

An additional enhancement includes sewing an internal pocket to the inside of the pouch at the juncture of the circular object cover section and the tab protruding from the back section.

Yet another enhancement includes sewing an internal pocket to the upper internal edge of the of the front and sides section.

In accordance with the foregoing objects, the invention in another embodiment contains a clear window for displaying the logo of the casino on the casino coin bucket and in yet another embodiment the closed end of the cylindrical carrier can incorporate a rigid material to hold the pouch in a cylindrical shape even when empty, which will allow the pouch to hold a casino coin bucket more securely.

Additional objects, advantages and features of the present invention will become apparent from the following description and appended claims, taken in conjunction with accompanying drawings.

BRIEF DESCRIPTION OF DRAWINGS

FIG. 1*a*–1*j* show the different pieces of material needed to create a preferred embodiment of the casino coin bucket pouch or carrier of this invention.

FIG. 1*a* shows a rectangular piece of material 11⅜ inches by 5⁵⁄₁₆ inches. Only one of these sections will be needed to construct the present invention.

FIG. 1*b* shows a t-shaped piece of material with a rectangular tab protruding from one end so that the entire piece of material looks like two rectangles, one large, and one small, with the small one situated above the larger one, protruding from, and centered on the wider portion of the larger rectangle. The larger rectangle is 6¼ inches by 5⅛ inches, and the smaller rectangle is 4¼ inches by 2⅞ inches. Only one of these sections will be needed to construct the present invention.

FIG. 1*c* is a rectangular piece of material 4¾ inches by 8³⁄₁₆ inches. Only one of these sections will be needed to construct the present invention.

FIG. 1*d* is a rectangular piece of material 1⁵⁄₁₆ inches by 15⁵⁄₈ inches. Only one of these sections will be needed to construct the present invention.

FIG. 1*e* is a rectangular piece of material 4³⁄₁₆ inches by 3¹⁄₁₆ inches. Only one of these sections will be needed to construct the present invention.

FIG. 1*f* is a rectangular piece of material 5 1/16 inches by 10 3/16 inches. Only one of these sections will be needed to construct the present invention.

FIG. 1*g* is a circular piece of material, 6 inches in diameter. Two of these sections will be needed to construct the present invention.

FIG. 1*h* is a mostly circular piece of material, 6 inches in diameter, with a cord 4 1/16 inches in length cut out of it. Two of these sections will be needed to construct the present invention.

FIG. 1*i* is a rectangular piece of material of 5 5/16 inches by 4 11/16 inches. Only one of these sections will be needed to construct the present invention.

FIG. 1*j* is a rectangular piece of material 2½ inches by 2⅞ inches. Two of these sections will be needed to construct the present invention.

FIG. 4 is a perspective view of a user with the carrier opened at both zippers for receiving a short coin bucket and configured for wearing or slinging around the user's shoulder with a shoulder pad;

FIG. 5 is a front elevational view of the carrier with a pocket for a cigarette pack and a broken away to show an exposed side of an internal zippered pouch for personal items;

FIG. 6 is a rear or back elevational view of the carrier with the carrier material and zippered pouch broken away to show another internally mounted pocket for holding hand-wipes and the like;

FIG. 7 is a side elevational view of the carrier with the cover closed in solid and open in phantom.

BEST MODE FOR CARRYING OUT THE INVENTION

Article

Figure 1A:
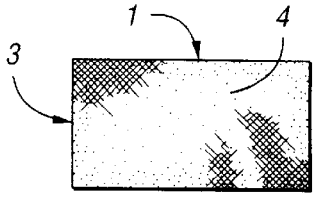
Figure 2:
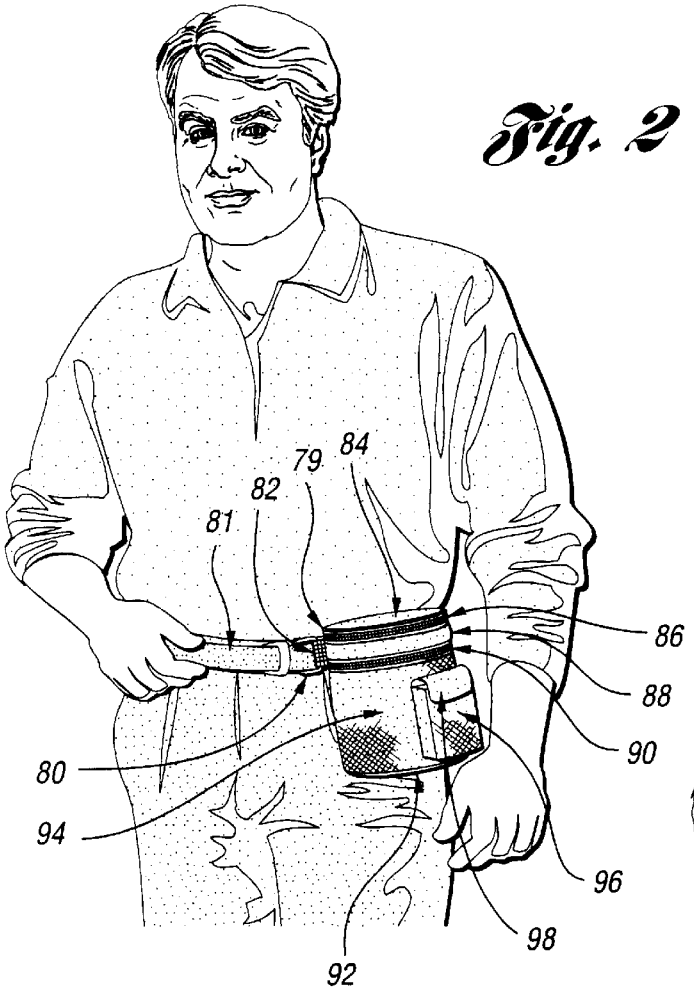
FIG. 2, is a perspective view of a user with the carrier closed and configured for wearing around the user's waist.
Figure 3:
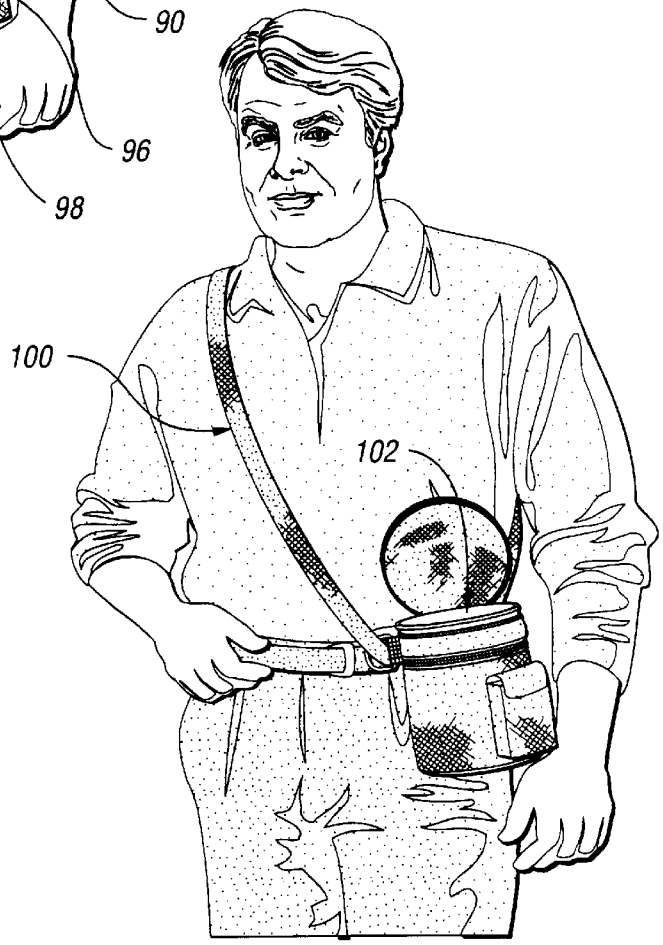
FIG. 3 is a perspective view of a user with the carrier opened at the upper zipper for receiving a tall coin bucket and configured for wearing or slinging around the user's shoulder.
Figure 8:
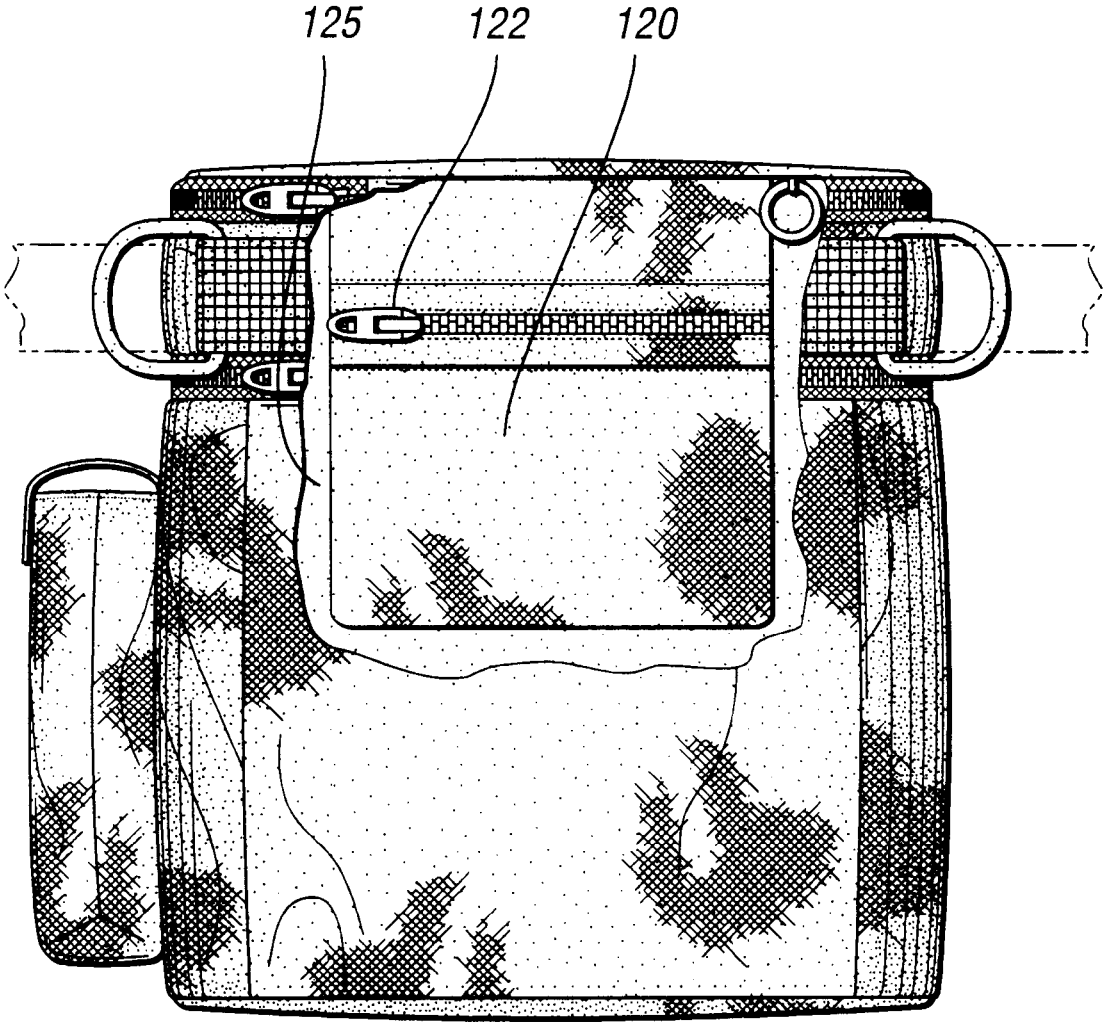
FIG. 8 is a rear elevational view of the carrier with the cover closed and broken away to show the internal zippered pouch with the zipper concealed between the pouch and carrier.

With reference to FIGS. 2 and 6, the coin carrier or pouch 79 includes two D-rings 80 and 108 attached to the pouch via key ring loops 82 and 109. This support arrangement allows a person to secure the pouch to his or her body using either a belt 81, or a shoulder strap 100 (depicted in FIG. 3). The pouch has a cover 84 which conceals and protects the coins contained within the open-top coin buckets contained within the pouch. With reference to FIG. 5, the pouch or carrier 79 forms a pocket 83 adapted to be supported by a user 87. The pocket 83 has first and second pocket portions or bucket configurations 89, 91. The pouch has a tall coin bucket configuration 89 of predetermined girth defined by a zipper 86 and a short coin bucket configuration 91 of predetermined girth defined by a zipper 90. The pocket portions 89, 91 are axially aligned and selectively connectable in accordance with their connection to contain and encircle a selective one of a plurality of coin buckets such as 102, 105. If the zipper 86 for the tall coin bucket 102 is open, and the zipper 90 for the short coin bucket 105 is closed, then the pocket portion 89 becomes a zipper insert, band or accommodation section of fabric 32 (FIG. 1*d*) which is between the zippers and remains attached to the front and side bucket support 94 preparing the pouch to receive a tall coin bucket 102 as depicted in FIG. 7. If the zipper 86 for the tall coin bucket 102 is closed and the zipper 90 for the short coin bucket 105 is open, then accommodation section 32 will be attached to the cover 84 and the pouch will be configured to receive the short coin bucket 105 as depicted in FIG. 4. Thus, zippers 86, 90 provide structure for reconnecting the pocket portions and cover to configure the carrier for the desired coin bucket size. Other fasteners could be used instead of zippers, such as buttons, hook and loop connections and snaps. FIG. 2 also shows the underside bucket support 92 which prevents the coin bucket from falling through the bottom of the pouch to the floor. FIG. 2 also shows a cigarette and lighter pouch 96 for holding a package of cigarettes and a cigarette lighter, and a cigarette and lighter pouch lid 98 for securing the package of cigarettes and the cigarette lighter.

FIG. 4 depicts a man carrying the pouch by means of a shoulder strap 100 which is equipped with a padded shoulder strap sleeve 106 to soften the load on the carrier's shoulder.

FIG. 5 shows a front elevation of the pouch 79 with a portion of the front cut away revealing the cleaner pocket 114 which the user can use to hold items such as wet naps, handi wipes or other similar items for personal hygiene.

FIG. 6 shows a rear elevation view of the pouch, with a section of the back cut away revealing the personal items pocket 115 and the personal items pocket zipper 116 which can be used to safely and securely store personal items such as cash, credit cards, hotel room keys, etc.

The inventor has found that Oxford cloth works best in this invention, though other materials work well also.

METHOD

The materials necessary to build the casino coin bucket pouch are as follows: 10 inches by 60 inches of Oxford cloth, two 14 inch polyester zippers, one 5 inch zipper, two plastic one inch D rings, two swivel snap hooks for one inch D-ring, one adjustable slider for one inch belting, one ⅝ inch plastic ring, one plastic canvas circle shaper, and serger thread.

Figure 1B:
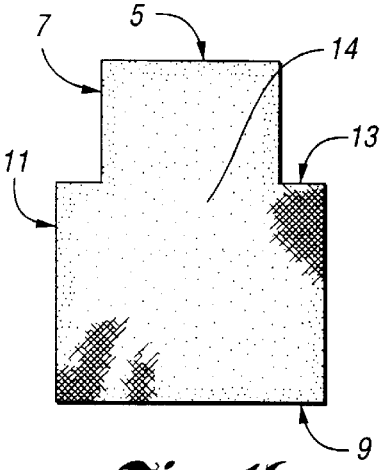
Figure 1B:
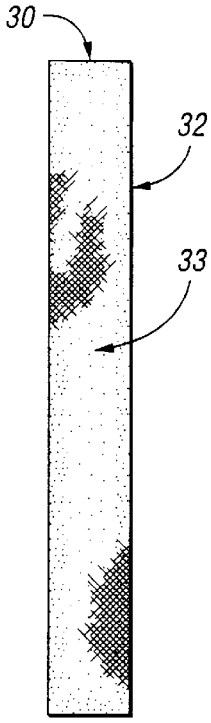
Figure 1C:
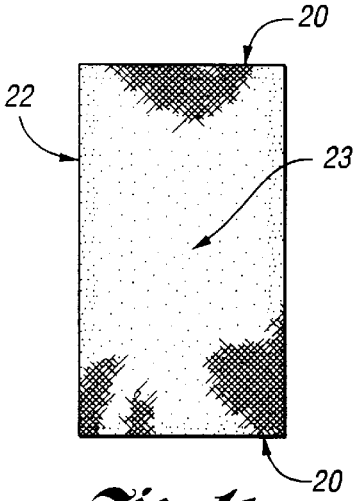

The first step in constructing the carrier of the present invention is to sew the "front and sides" section 4 (FIG. 1*a*) to the "back" section 14 (FIG. 1*b*). The "front and sides" section 4 should be sewn to the "back" section 14 such that the short side of the "front and sides" section 3 is sewn to the short side 11 of the main rectangle of the back section 14. After completing that step, the free short side 3 of the front and sides section 4 should be sewn to the free short side 11 of the main rectangle of the back section 14. Once these steps are completed, these two sections 4 and 14 should be sewn together such that they form a cylinder.

Figure 1E:
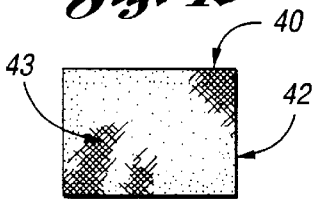
Figure 1F:
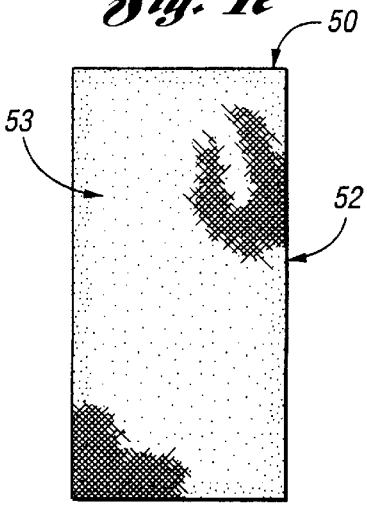
Figure 1G:
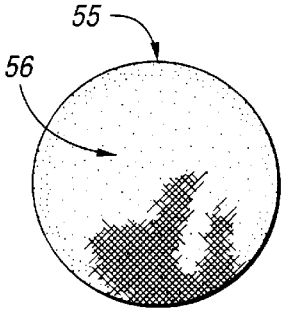

The next step is to insert a plastic canvas shaper (not shown) between two "bottom" sections 56 (FIG. 1*g*). Then take the two "bottom" sections 56 with the plastic canvas shaper inserted in between them and sew them to the end of the cylindrical unit, described above, which was formed by sewing the "front and sides" section 4 to the "back" section 14, such that it joins the cylindrical unit on the side opposite the rectangular tab 5 protruding from the main rectangle of the back section 14.

The next step is to sew one side of the first 14 inch polyester zipper 90 to the open edge of the cylinder which was formed when the "front and sides" section 4 was sewn to the "back" section 14. Start sewing the 14 inch polyester zipper at one edge of the tab 5 protruding from the main rectangle of the back section 14, and, sewing along the opening of the cylinder until you reach the opposite end of the protruding tab. Next, sew the other half of the first 14 inch polyester zipper 90 to the long side of the "front zipper insert" section 32, such that the 14 inch polyester zipper is centered on the long side of the "front zipper insert" 32

Figure 1H:
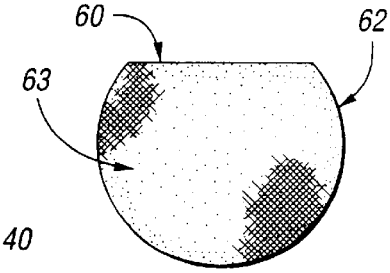

Next, sew one half of the second 14 inch polyester zipper 86 to the opposite long side of the "front zipper insert" section 32, again, taking care to center the zipper on that section. Next, serge the edges of the "cardholder" section 43 (FIG. 1*e*). Next, sew the "cardholder" section 43 to one of the "top" sections 63 (FIG. 1*h*) such that both long sides 40 of the cardholder section, and only one short side 42 of the cardholder section are sewn down, leaving one short side of the cardholder section 43 open, which will form a pocket between the "cardholder" section 43 and the "top" section 63.

Next, sew a second "top" section 63 (FIG. 1*h*) to the first "top" section 63 on the side opposite to the side to which the "cardholder" section 43 has been sewn. When doing so, be sure to align the straight portions 60 of the perimeter of both top sections 63. Next, sew the remaining half of the second 14 inch polyester zipper 90 to the two top sections 63. Then sew the two "top sections" 63 to the long side of the tab 5 protruding from the back section 14 such that the straight portions 60 of the perimeter of the "top sections" 63 is aligned with and centered on the long side of the tab 5 protruding from the back section.

Take the first "loop" section 73 (FIG. 1*j*) and fold it in half such that the long sides 72 of the loop section 73 are aligned with one another. Then serge both long sides 72 of the loop section together. Then fold the "loop" section in half such that the two remaining shorter sides 70 are aligned next to one another. Insert a plastic D-ring onto the folded "loop" section 73 and then sew the two shorter sides 70 of the loop section to the short side 30 of the "front zipper insert" section 33. Repeat these for the other "loop" section 73, sewing it to the other short side 30 of the "front zipper insert" section 33.

Sew one short side 30 of the "front zipper insert" section 33 to the short side 7 of the tab protruding from the "back" section such that the 14 inch polyester zipper halves on the front zipper insert 33, the top section 63, and the front and side section 4 come into alignment. Sew the other short side 30 to the other short to the tab 7.

Sew one half a five inch zipper to the short side 50 of the "money pocket" section 53 (FIG. 1*f*), then sew the other half of the five inch zipper to the other short side of the money pocket section 53. Fold the "money pocket" section 53 such that the two halves of the five inch zipper come into alignment. Then serge the edges of this folded "money pocket" section 53 along the edges which are perpendicular to the five inch zipper. The sew the money pocket section 53 to the two top sections 63 such that short side 50 of the money pocket section 53 are aligned with the straight portion 60 of the perimeter of the top sections 63, and such that the zipper of the money pocket section 53 faces towards the tab 5 protruding from the back section 14.

Figure 1I:
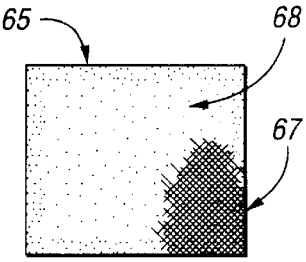
Figure 1K:
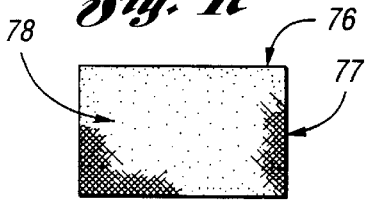
FIG. 1*k* is a rectangular piece of material 4¾ inches by 3 1/16 inches. Only one of these sections will be needed to construct the present invention.
Figure 1J:
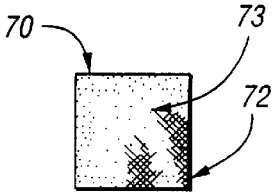

Serge the long side 65 of the "cleaner pocket" section 68 (FIG. 1*i*). Fold the "cleaner pocket" section 68 in half such that the two serged edges of the long sides 65 of the cleaner pocket section 68 come into alignment. With the "cleaner pocket" section 68 folded into this position, serge the folded short sides 67 of the cleaner pocket section together, forming a pocket. Sew this pocket to the 14 inch polyester zipper which was previously sewn into the "front and sides" section 4.

To construct cigarette holder pocket, first bring clipped edges together and serger bottom tuck. Serge on side from bottom to top edge. Serger other edges open. Serger top edge and top stitch down. Sew hook and loop fabric, such as trademarked Velcro to front of holder. After serging edges, sew cigarette & lighter flap to top edge of Holder pocket. Sew Velcro to underside of front edge of flap. Sew pocket to bag. Sew other edges closed.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A top opening carrier for carrying one of a plurality of differently sized coin buckets comprising:

a cylindrical pocket adapted to be supported by the user and having first and second axially aligned and at least partially connectable cylindrical open top portions configured in accordance with their connection to contain a respective one of the plurality of differently sized coin buckets;

the first portion having an open bottom and the second portion having a closed bottom;

the first cylindrical open top portion when at least partially connected to said open top of the second portion being configured to contain, but not cover the top of, a coin bucket of one size; and the second cylindrical open top pocket portion when at least partially disconnected from said open bottom of the first portion being configured to contain, but not to cover the top of, a coin bucket of another size; and a cover at least partially disconnected to the first portion.

2. A carrier of claim 1 wherein the cylindrical pocket includes an internal pouch configured to contain personal items.

3. The carrier of claim 1 including an at least partially disconnectable cover for closing the open top of the cylindrical pocket.

4. The carrier claim 1 including a zipper for connecting the first and second cylindrical pocket portions.

5. The carrier of claim 4 including a cover for closing the open top of the cylindrical pocket and a pair of zippers, one of which is for connecting the first and second cylindrical pocket portions and the other of which is for connecting the cover to the first cylindrical pocket portion.

6. The carrier of claim 1 including a belt connected to the cylindrical pocket and supported by the user.

7. A carrier of claim one including a shoulder strap connected to the cylindrical pocket and supported by the user.

8. The carrier of claim 7 wherein the shoulder strap is padded.

9. A method of making a carrier of predetermined length which can be worn by a person for the purpose of securing and bearing the weight of differently sized cylindrical objects, comprising:

providing a back section of sufficiently sturdy material to support cylindrical object of one size full of coins, the sides of which run the entire pre-determined length of the pouch and the end of which has a tab protruding therefrom, providing a mostly circular cover section, made of the material, sewing the cover section to the top of the tab protruding from one portion of the back section, providing a first rectangular central section, made of the material, and having a width approximately equal to the circumference of the circular cover section minus the width of the tab protruding from the end of the back section, and with the rectangular central section having an axial dimension of the ends thereof approximately equal to the protrusion of the tab from the end of the back section, sewing the rectangular central section to the tab protruding from the back section such that the stitches join the sides of the tab to the ends of the upper central section, providing a circular object support section, made of the material and having a circumference approximately equal to the circumference of the cover section, and sewing the object support section to the back section on the side opposite to the side having the protruding tab, providing a second rectangular central section, made of the material and having a width approximately equal to the circumference of the object support section minus the width of the back section, and having an axial dimension at the ends thereof approximately equal to the axial dimension of the back section minus the protrusion of the tab from the back section, sewing the second rectangular central section to the back section such that the stitches join the second rectangular central section to the sides of the back section, sewing the second rectangular central section to the circular object support section, and connecting the circular cover section to one side of the first rectangular central section by reconnectable means, and connecting the other side of the first rectangular central section to the second rectangular central section by reconnectable means.

10. The method of claim 9, further comprising:

sewing an internal pocket of said sturdy material to the inside of said pouch at the juncture of the top section and the tab protruding from the upper portion of the back section.

11. The method of claim 9, further comprising:

sewing an internal pocket made of said sturdy material to the internal edge of the upper horizontal portion of the front and sides section.

12. The method in claim 9, further comprising:

sewing two rectangular segments of sufficiently sturdy material having a vertical height approximately equal to the axial dimension of the upper central section to the vertical portions of the tab protruding from the back section, such that only one rectangular segment is sewn to each vertical portion of said tab, and folding both rectangular segments of said sturdy material in half, inserting D-rings over the free end of each rectangular segment and sewing each free half such that it forms a loop.

13. The method of claim 12, further comprising:

sewing an internal pocket of said sturdy material to the inside of said pouch at the juncture of the top section and the tab protruding from the upper portion of the back section.

14. The method of claim 12, further comprising:

sewing an internal pocket made of said sturdy material to the internal edge of the upper horizontal portion of the front and sides section.

15. A method of making a carrier for a plurality of open-top coin buckets of predetermined girths and different lengths comprising:

forming one pocket having a sufficient girth to encircle the predetermined girth of one coin bucket to the extent of the length of the one bucket, forming a band having a sufficient girth to encircle at least a portion of the girth of the one bucket, connecting the band to the one pocket along their common girths with reconnecting structure to form another pocket having a sufficient girth to encircle the predetermined girth of the other bucket to the extent of the length of the other bucket, forming a cover having a sufficient girth to close the open-top of the other bucket when the other bucket is in the other pocket, and connecting the cover to the other pocket along their common girths with reconnecting structure, whereby to conceal the contents of either bucket when in its respective pocket.

* * * * *